US010490958B2

(12) United States Patent
Aoki et al.

(10) Patent No.: US 10,490,958 B2
(45) Date of Patent: Nov. 26, 2019

(54) CONNECTOR

(71) Applicant: JAPAN AVIATION ELECTRONICS INDUSTRY, LIMITED, Shibuyaku, Tokyo (JP)

(72) Inventors: Shigeharu Aoki, Tokyo (JP); Takashi Tokunaga, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/660,761

(22) Filed: Mar. 17, 2015

(65) Prior Publication Data

US 2015/0270658 A1 Sep. 24, 2015

(30) Foreign Application Priority Data

Mar. 18, 2014 (JP) ..... 2014-055114

(51) Int. Cl.
*H01R 24/60* (2011.01)
*H01R 12/71* (2011.01)
(Continued)

(52) U.S. Cl.
CPC ..... *H01R 24/60* (2013.01); *H01R 4/48* (2013.01); *H01R 12/716* (2013.01); *H01R 12/91* (2013.01);
(Continued)

(58) Field of Classification Search
CPC ..... H01R 13/28; H01R 12/91; H01R 24/84; H01R 12/716; H01R 24/60
(Continued)

(56) References Cited

U.S. PATENT DOCUMENTS 4,586,772 A * 5/1986 Cobaugh ..... H01R 12/89 439/325
6,155,858 A * 12/2000 Ozawa ..... H01R 13/6315 439/248
(Continued)

FOREIGN PATENT DOCUMENTS

CN 100483859 C 4/2009
JP 2010272320 A 12/2010
TW M472992 U 2/2014

OTHER PUBLICATIONS

Taiwanese Office Action dated Oct. 4, 2016 issued in counterpart Taiwanese Application No. 104107051.

*Primary Examiner* — Tulsidas C Patel
*Assistant Examiner* — Marcus E Harcum
(74) *Attorney, Agent, or Firm* — Holtz, Holtz & Volek PC

(57) ABSTRACT

A contact realizing excellent transmission of high-speed signals by reducing a transmission path length and electric influence of adjacent contacts. In a first housing disposed on a circuit board, a second housing is fitted for receiving a mating connector therein in a manner movable in a moving direction orthogonal to a receiving direction. Each contact includes a contact portion brought into contact with an associated mating contact of the mating connector, a connection portion connected to the circuit board, and an elastically deformable linking portion connecting the contact and connection portions. The second and first housings hold the contact and connection portions, respectively. A dimension A of the linking portion in the receiving direction and a dimension B of the linking portion in a front-rear direction orthogonal to both the receiving and contact arranging directions is set to e.g. A>B.

8 Claims, 19 Drawing Sheets

(51) Int. Cl.
*H01R 13/6461* (2011.01)
*H01R 4/48* (2006.01)
*H01R 12/91* (2011.01)
*H01R 13/6474* (2011.01)
*H01R 107/00* (2006.01)

(52) U.S. Cl.
CPC ..... *H01R 13/6461* (2013.01); *H01R 13/6474* (2013.01); *H01R 2107/00* (2013.01)

(58) Field of Classification Search
USPC ..... 439/248, 637, 247
See application file for complete search history.

(56) References Cited

U.S. PATENT DOCUMENTS 6,390,828 B1 * 5/2002 Yamaguchi ..... H01R 13/631 439/247
6,988,900 B1 * 1/2006 Meister ..... H01R 12/716 438/544
7,114,963 B2 * 10/2006 Shuey ..... H01R 23/6873 439/660
8,152,548 B2 4/2012 Masuda et al.
8,257,095 B2 * 9/2012 Akai ..... H01R 12/716 439/248
8,668,499 B2 * 3/2014 Takahashi ..... H01R 12/721 439/61
8,870,600 B2 * 10/2014 Wu ..... H01R 13/05 439/637
9,450,318 B2 * 9/2016 Hasegawa ..... H01R 12/716
2005/0032406 A1 * 2/2005 Shiota ..... H01R 13/6315 439/247
2006/0258199 A1 * 11/2006 Umehara ..... H01R 13/33 439/247
2006/0276061 A1 * 12/2006 Koguchi ..... H01R 12/725 439/74
2007/0202729 A1 * 8/2007 Uesaka ..... H01R 12/57 439/248
2013/0196550 A1 * 8/2013 Casher ..... H01R 12/724 439/660
2014/0213115 A1 * 7/2014 Kimura ..... H01R 24/60 439/629
2015/0024620 A1 * 1/2015 Kobayashi ..... H01R 12/716 439/345
2015/0044901 A1 * 2/2015 Doi ..... H01R 12/65 439/374
2016/0294111 A1 * 10/2016 Kobayashi ..... H01R 13/187
2019/0013610 A1 * 1/2019 Suzuki ..... H01R 13/10

* cited by examiner

PRIOR ART

CONNECTOR

BACKGROUND OF THE INVENTION

Field of the Invention

This invention relates to a connector.

Description of the Related Art

Conventionally, as shown in FIGS. 18 and 19, there has been proposed a jack-type connector 930A which can be fitted on a plug-type connector 910 (see Japanese Laid-Open Patent Publication (Kokai) No. 2010-272320). The connector 930A is a floating connector which can compensate for misalignment between the connector 930A and the connector 910.

The connector 930A is comprised of contacts 931A, and a body 932A that supports the contacts 931A. The body 932A has a fitting portion 933A having a rectangular hollow prism shape which can receive a body 912 of the connector 910, and a hollow prism portion 951 having a rectangular hollow prism shape, which is arranged in a manner surrounding the fitting portion 933A.

Each contact 931A includes a connection portion 936A for being connected to an associated one of contacts 911 of the connector 910, a lead portion 937 which is soldered to a conductor on a circuit board, and an extendable portion 954 which can extend and contract in a Y1-Y2 direction between the connection portion 936A and the lead portion 937. The extendable portion 954 is formed into a substantially N-shape, and has two folded portions.

One end of the extendable portion 954 is held by the fitting portion 933A, and the other end of the extendable portion 954 is held by the hollow prism portion 951, and hence extension and contraction of the extendable portion 954 in the Y1-Y2 direction allows the fitting portion 933A to be displaced relative to the hollow prism portion 951 in the Y1-Y2 direction. As a result, the misalignment between the connector 910 and the connector 930A is compensated for.

If the extendable portion 954 is configured, by changing the design of the above-mentioned connector 930A, such that it is extended and contracted in a X1-X2 direction to thereby allow the fitting portion 933A to be displaced relative to the hollow prism portion 951 in the X1-X2 direction, it is also possible to compensate for misalignment between the connector 910 and the connector 930A in the X1-X2 direction.

However, when the fitting portion 933A is displaced relative to the hollow prism portion 951 in the X1-X2 direction, the contacts 931A are made easy to be electrically influenced by adjacent ones, which makes it difficult to transmit high-speed signals.

Further, the extendable portion 954 is formed into a substantially N-shape, and has a long transmission path, which degrades the electrical characteristics and makes it difficult to transmit high-speed signals.

SUMMARY OF THE INVENTION

The present invention has been made in view of these circumstances, and an object thereof is to reduce a transmission path length and make contacts difficult to be electrically influenced by adjacent ones, to thereby realize excellent transmission of high-speed signals.

To attain the above object, in a first aspect of the present invention, there is provided a connector comprising a housing, and a plurality of contacts that are held by the housing, the housing including a first housing that is mounted on an object to be connected, and a second housing that is capable of receiving a mating connector and is fitted in the first housing in a manner movable in a moving direction orthogonal to a direction of receiving the mating connector, each contact including a contact portion that is held by the second housing and is brought into contact with an associated one of mating contacts of the mating connector, a connection portion that is held by the first housing and is connected to the object to be connected, and a linking portion that is elastically deformable and connects the contact portion and the connection portion, wherein when a dimension of the linking portion in the receiving direction is represented by A, and a dimension of the linking portion in an orthogonal direction orthogonal to both the receiving direction and a direction of arranging the contacts is represented by B, A>B holds.

Preferably, A is approximately two or more times as large as B.

To attain the above object, in a second aspect of the present invention, there is provided a connector comprising a housing, and a plurality of contacts that are held by the housing, the housing including a first housing that is mounted on an object to be connected, and a second housing that is capable of receiving a mating connector and is fitted in the first housing in a manner movable in a moving direction orthogonal to a direction of receiving the mating connector, each contact including a contact portion that is held by the second housing and is brought into contact with an associated one of mating contacts of the mating connector, a connection portion that is held by the first housing and is connected to the object to be connected, and a linking portion that is elastically deformable and connects the contact portion and the connection portion, wherein when a dimension of the linking portion in the receiving direction is represented by A, and a dimension of the linking portion in an orthogonal direction orthogonal to both the receiving direction and a direction of arranging the contacts is represented by B, A<B holds.

Preferably, A is not larger than approximately half of B.

In the first and second aspects of the invention, preferably, the linking portion includes a linear portion, a first bent portion which is continuous with one end of the linear portion, and a second bent portion which is continuous with the other end of the linear portion.

In the first and second aspects of the invention, more preferably, a middle portion of the linear portion is smaller in width than the other portion of the linear portion.

In the first and second aspects of the invention, more preferably, opposite end portions of the linear portion are larger in width than the contact portion.

In the first and second aspects of the invention, preferably, the moving direction is at least the contact arranging direction.

In the first and second aspects of the invention, preferably, the contacts are arranged in the contact arranging direction in two rows.

According to the present invention, it is possible to reduce a transmission path length, and make contacts difficult to be electrically influenced by adjacent ones, to thereby realize excellent transmission of high-speed signals.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
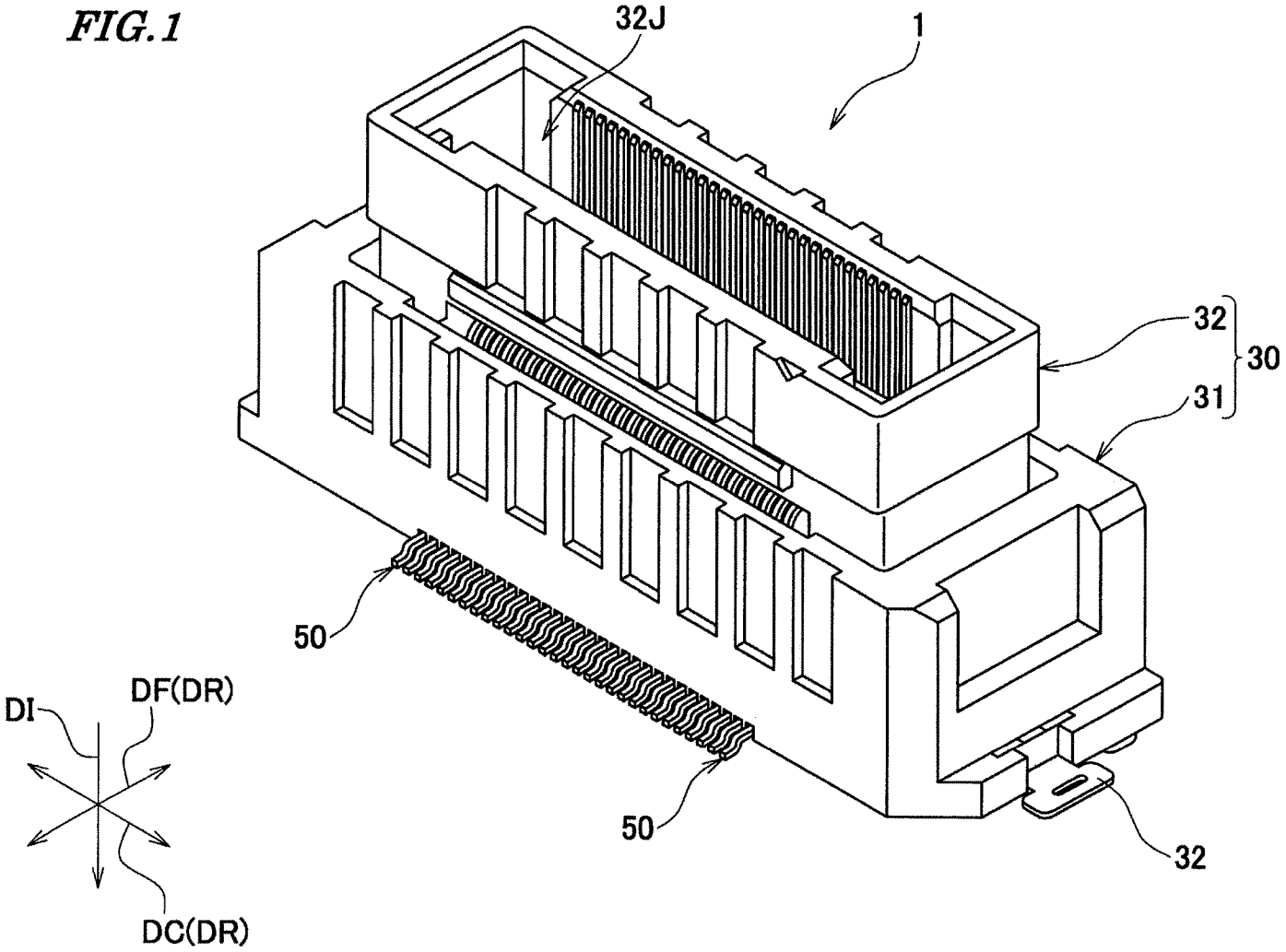
FIG. 1 is a perspective view of a connector according to a first embodiment of the present invention.
Figure 2:
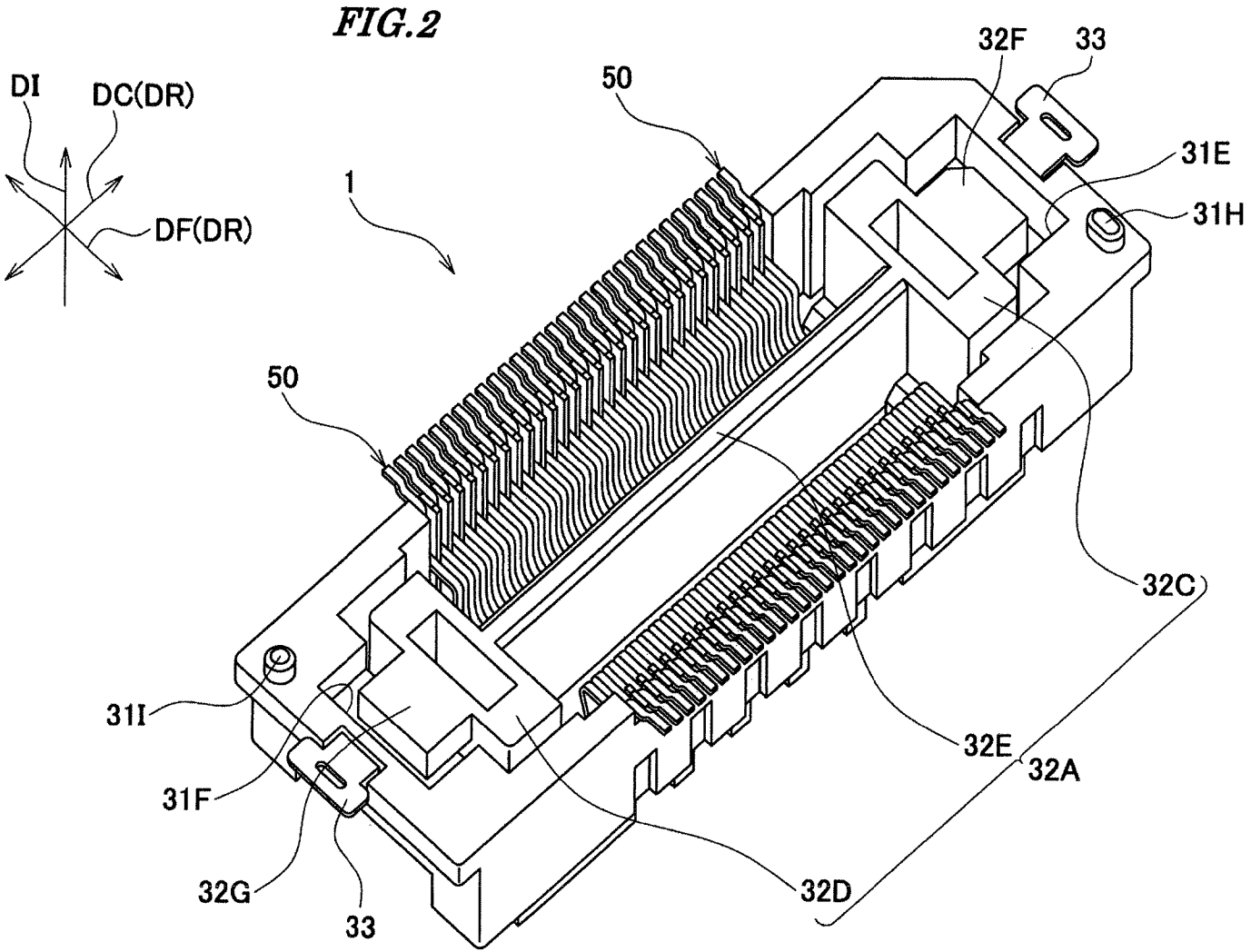
FIG. 2 is a perspective view of the connector, in a state in which the connector shown in FIG. 1 is inverted upside down.
Figure 3:
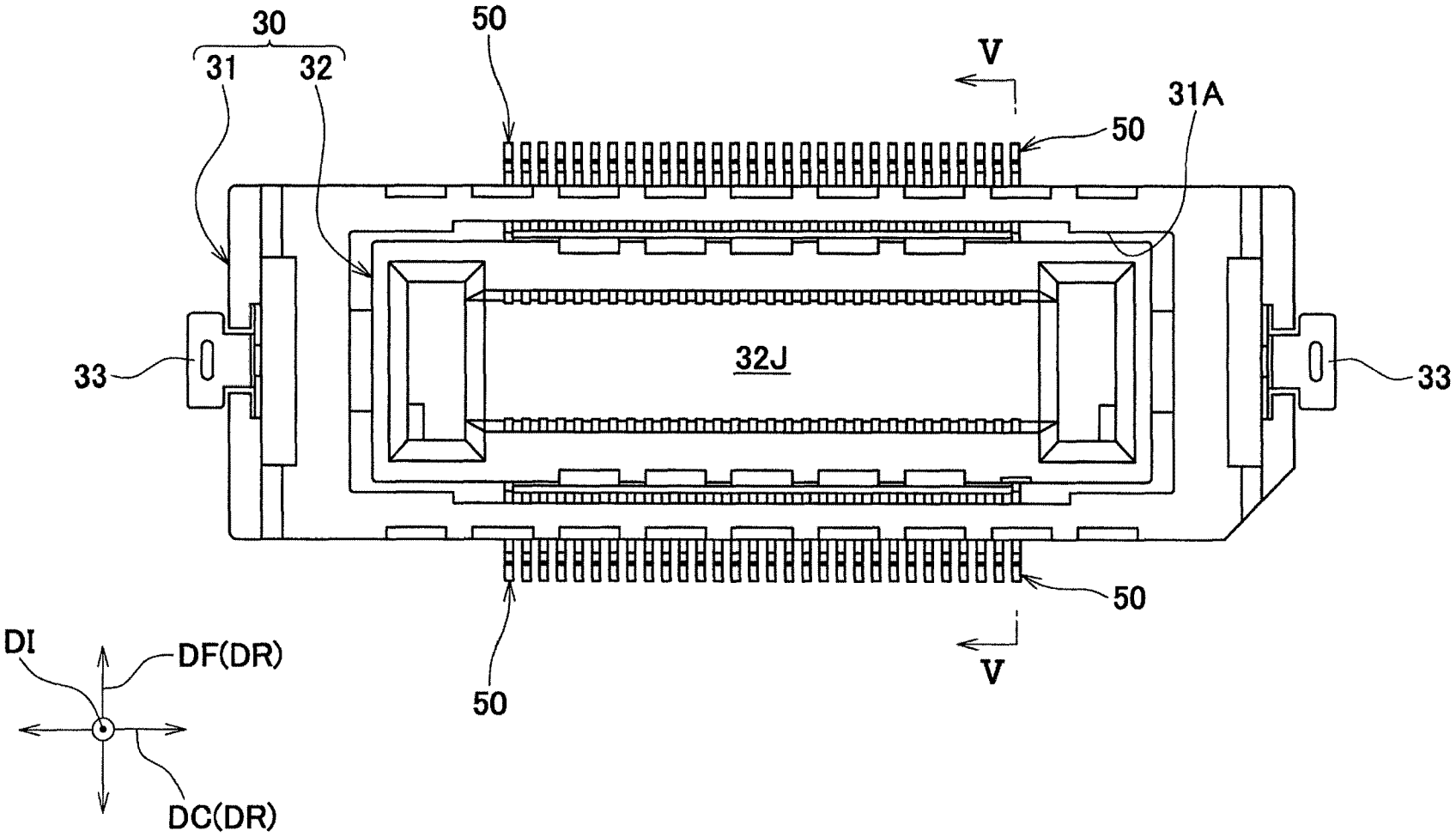
FIG. 3 is a plan view of the connector shown in FIG. 1.
Figure 4:
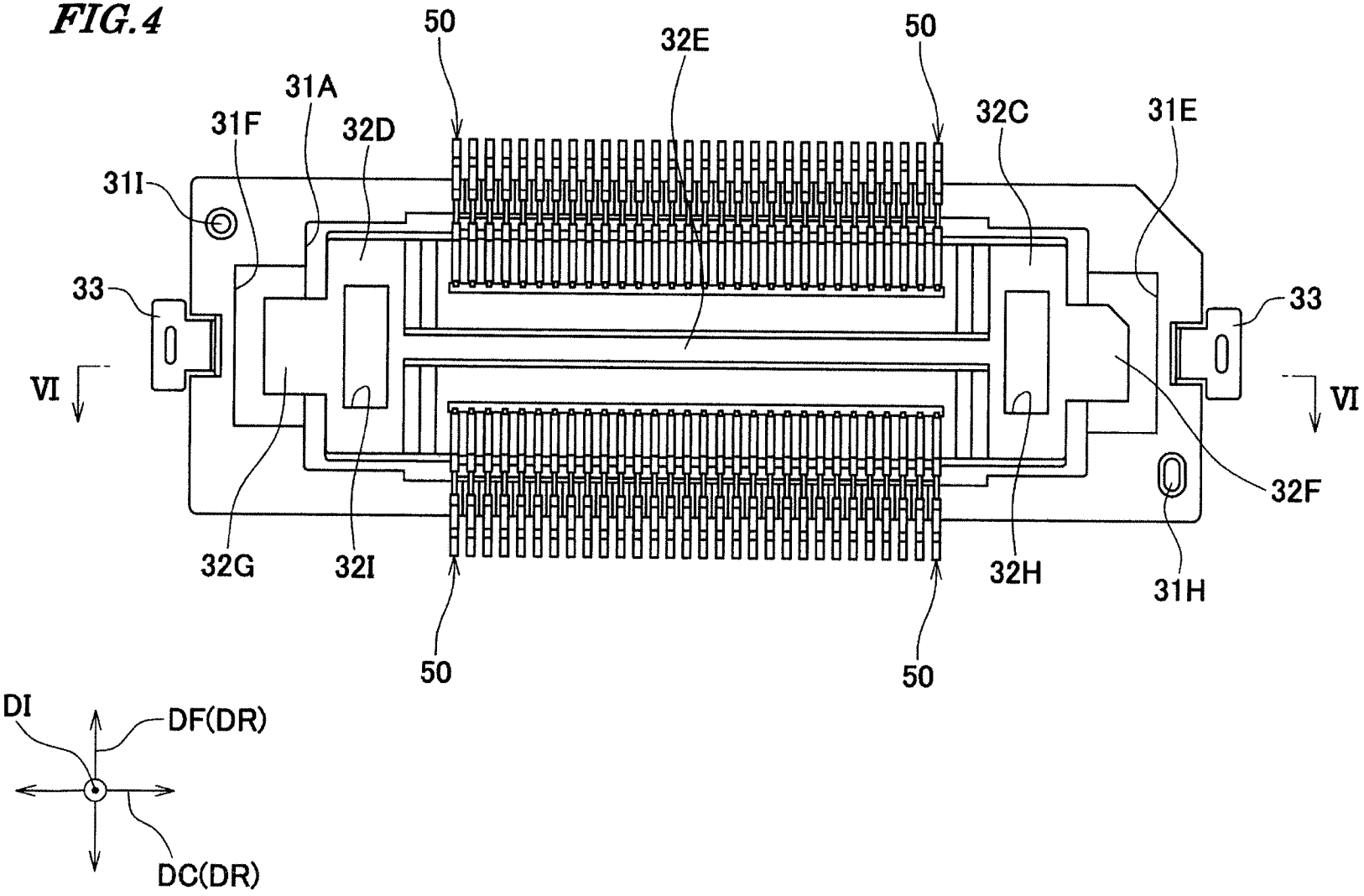
FIG. 4 is a bottom view of the connector shown in FIG. 1.

As shown in FIGS. 1 and 2, a connector 1 according to a first embodiment of the present invention is a connector for high-speed transmission, and is comprised of a housing 30 and a plurality of contacts 50 which are held by the housing 30. The contacts 50 are arranged in a contact arranging direction (direction of arranging the contacts) DC in two rows.

The housing 30 includes a first housing 31 that is disposed on a printed circuit board (object to be connected), not shown, and a second housing 32 that is capable of receiving a mating connector (not shown) therein and is fitted in the first housing 31 in a manner movable in moving directions DR (two directions in the present embodiment: the contact arranging direction DC and a front-rear direction DF, referred to hereinafter) orthogonal to a receiving direction DI in which the mating connector is received. The term "orthogonal" used here refers to a state of intersection including a state which is not orthogonal in strict meaning. The first housing 31 and the second housing 32 are both made of insulating resin.

As shown in FIGS. 3 to 7, the first housing 31 has a rectangular hollow prism shape, and has a receiving space 31A. Two opposed surfaces of inner wall surfaces of the first housing 31 are each formed with a recess 31B which extends in the contact arranging direction DC. An upper end of the recess 31B reaches an upper surface of the first housing 31, and a lower end of the same reaches a lower surface of the housing 31. Further, respective surfaces of the two recesses 31B, which are opposed to each other, are each formed with a plurality of press fitting grooves 31C at predetermined intervals in the contact arranging direction DC. The first hosing 31 has a bottom surface formed with a plurality of grooves 31D. The plurality of grooves 31D communicate with the press fitting grooves 31C, respectively.

The first housing 31 is formed with an accommodating recess 31E in an inner bottom surface of one end thereof in the contact arranging direction DC, and an accommodating recess 31F in an inner bottom surface of the other end thereof in the contact arranging direction DC. The accommodating recess 31E is larger in depth than the accommodating recess 31F. Further, the first housing 31 is formed with press-fitting holes 31G in respective bottom surfaces of opposite end portions thereof in the contact arranging direction DC (see FIG. 6). A holddown 33 is press-fitted in each press-fitting hole 31G.

The first housing 31 is formed with protrusions 31H and 31I on the bottom surface thereof at locations diagonal to each other. The protrusions 31H and 31I are formed for positioning the first housing 31 on the printed circuit board.

The second housing 32 includes an insertion part 32A and a fitting part 32B. The insertion part 32A is formed by a side wall portion 32C, a side wall portion 32D, a partition portion 32E, a protruding portion 32F, and a protruding portion 32G. The side wall portion 32C has a rectangular hollow prism shape, and has a cavity 32H. The side wall portion 32D has a rectangular hollow prism shape, and has a cavity 32I. The side wall portion 32C and the side wall portion 32D are opposed to each other in the contact arranging direction DC. The partition portion 32E is plate-shaped and partitions a space between the side wall portion 32C and the side wall portion 32D into two spaces. The protruding portion 32F protrudes from a lower portion of the side wall portion 32C in the contact arranging portion DC. The protruding portion 32F has a thickness substantially equal to the depth of the accommodating recess 31E. The protruding portion 32G protrudes from a lower portion of the side wall portion 32D in the contact arranging portion DC. The protruding portion 32G has a thickness substantially equal to the depth of the accommodating recess 31F. The protruding portion 32F is accommodated in the accommodating recess 31E in a manner movable in the moving directions DR, and the protruding portion 32G is accommodated in the accommodating recess 31F in a manner movable in the moving directions DR. Therefore, although the protruding portion 32F and the protruding portion 32G are capable of moving in the moving direction DR after the connector 1 is mounted on the printed circuit board, even if the second housing 32 is pulled upward (in a direction opposite to the receiving direction DI), the second housing 32 is prevented from being removed from the first housing 31. Further, even when an attempt is made to rotate the second housing 32 about an axis parallel to the contact arranging direction DC, the second housing 32 is hardly rotated.

The fitting part 32B has a rectangular hollow prism shape having a bottom portion. The bottom portion of the fitting part 32B is continuous with an upper portion of the insertion part 32A. The fitting part 32B has a receiving space 32J for receiving the mating connector therein. Two opposed ones of inner wall surfaces of the fitting part 32B are each formed with a plurality of grooves 32K at predetermined intervals in the contact arranging direction DC. The grooves 32K each extend in the receiving direction DI. The fitting part 32B has a bottom portion formed with a plurality of press-fitting holes 32L. The plurality of press-fitting holes 32L each extend in the receiving direction DI and communicate with the grooves 32K, respectively.

As shown in FIGS. 1 to 4 and the like, the plurality of contacts 50 are arranged at predetermined intervals (at equally-spaced intervals in the present embodiment) in the contact arranging direction DC. The contacts 50 are each formed by blanking a metal plate into a predetermined shape, and bending the blank.

Figure 8:
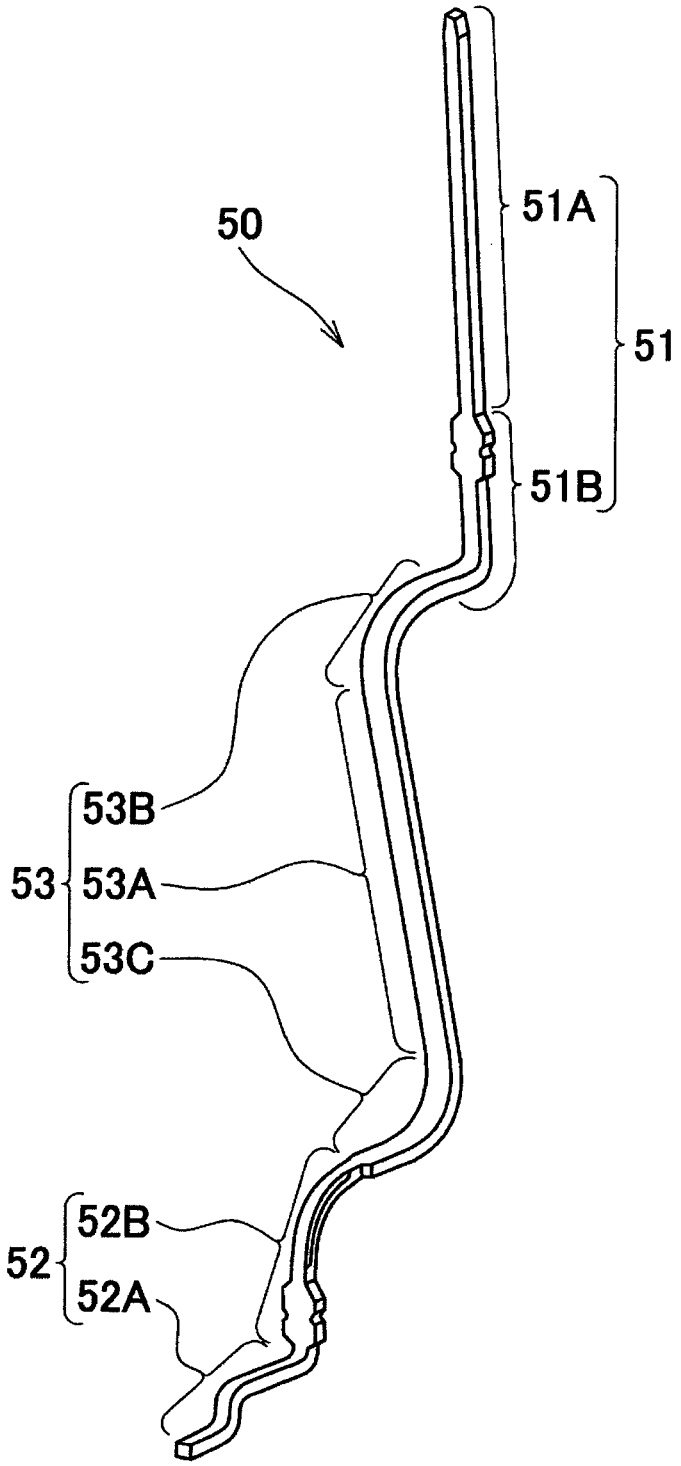
FIG. 8 is a perspective view of a contact of the connector shown in FIG. 1.
Figure 9:
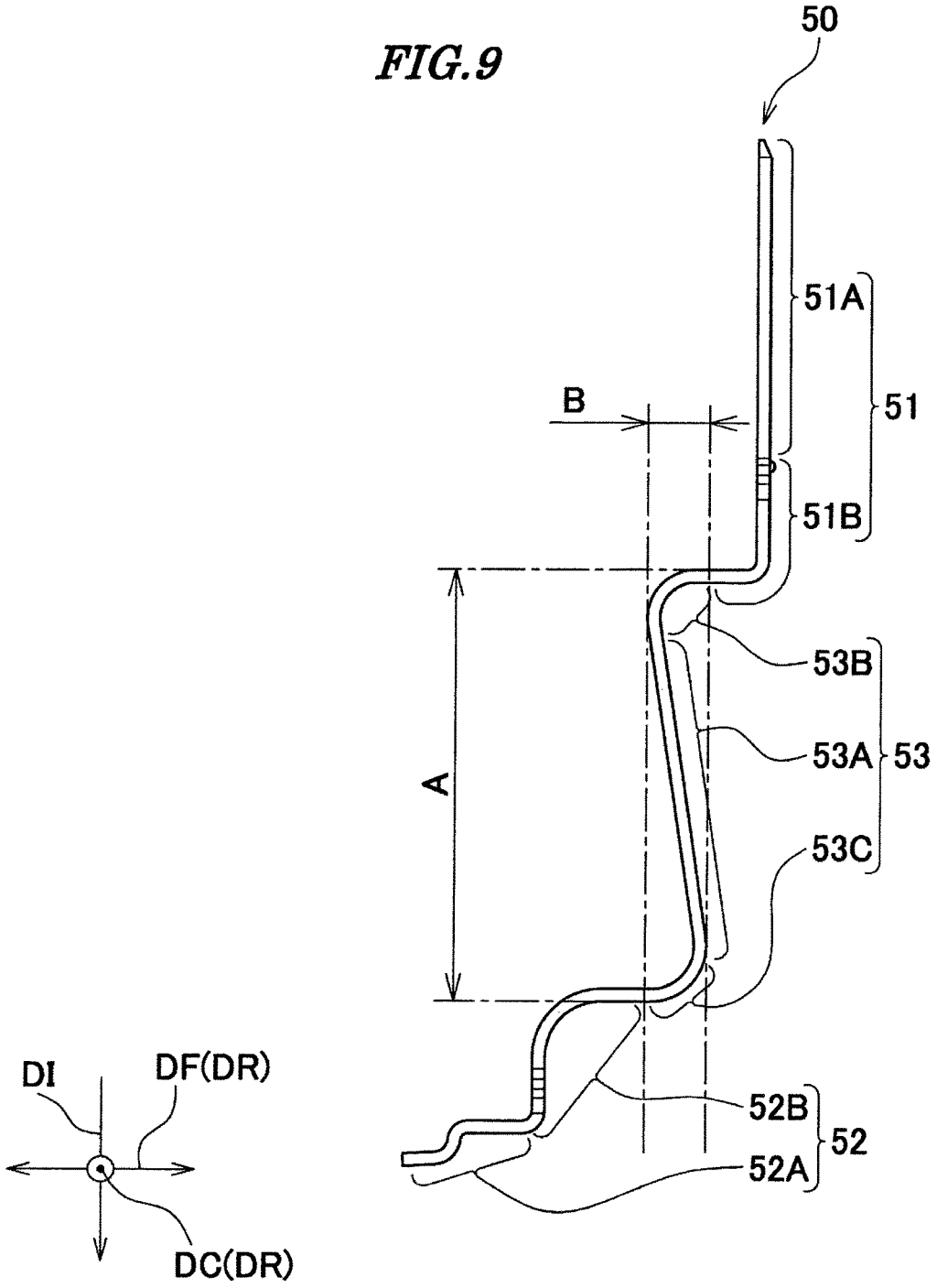
FIG. 9 is a side view of the contact shown in FIG. 8.
Figure 10:
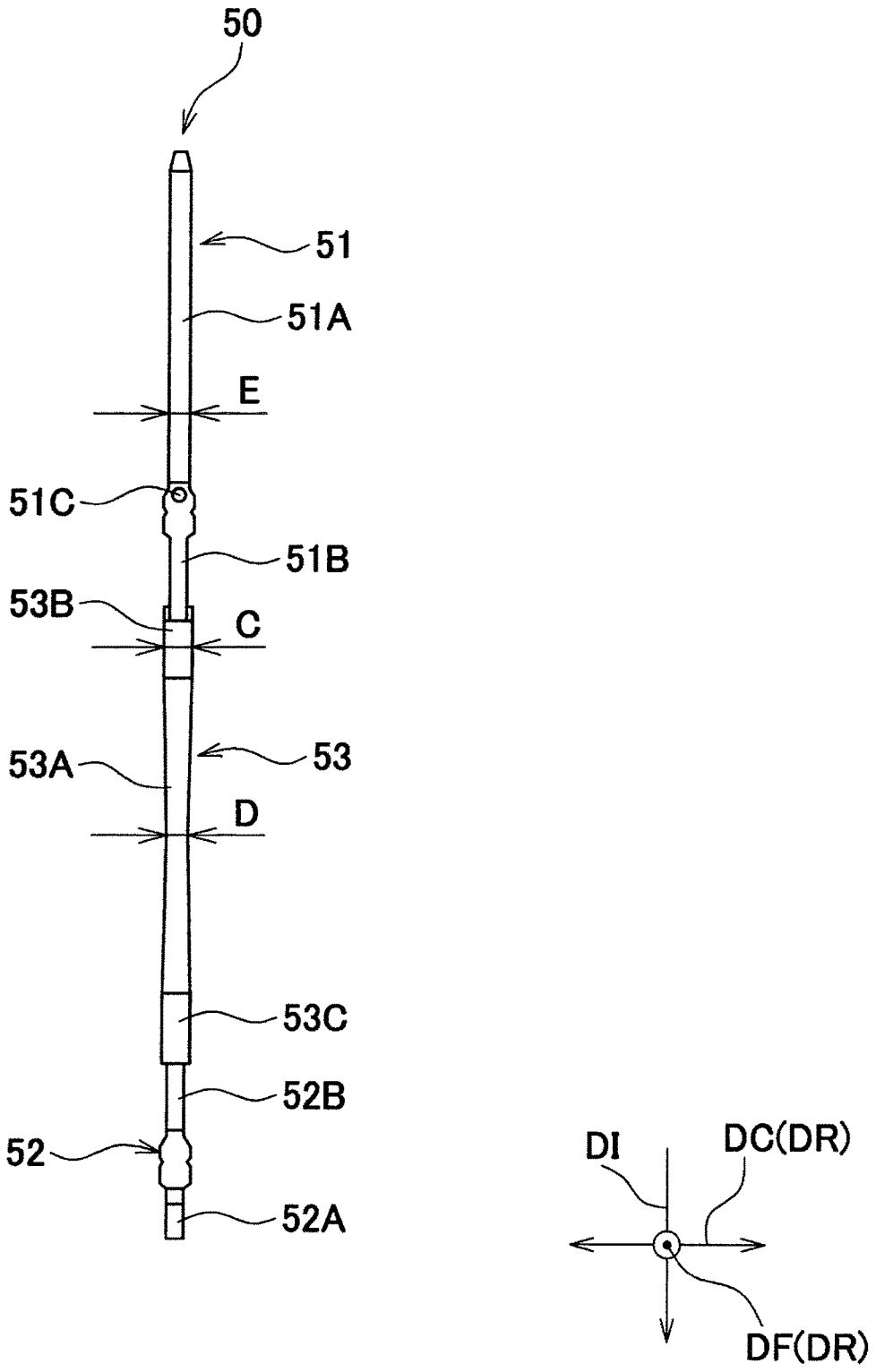
FIG. 10 is a front view of the contact shown in FIG. 8.
Figure 11:
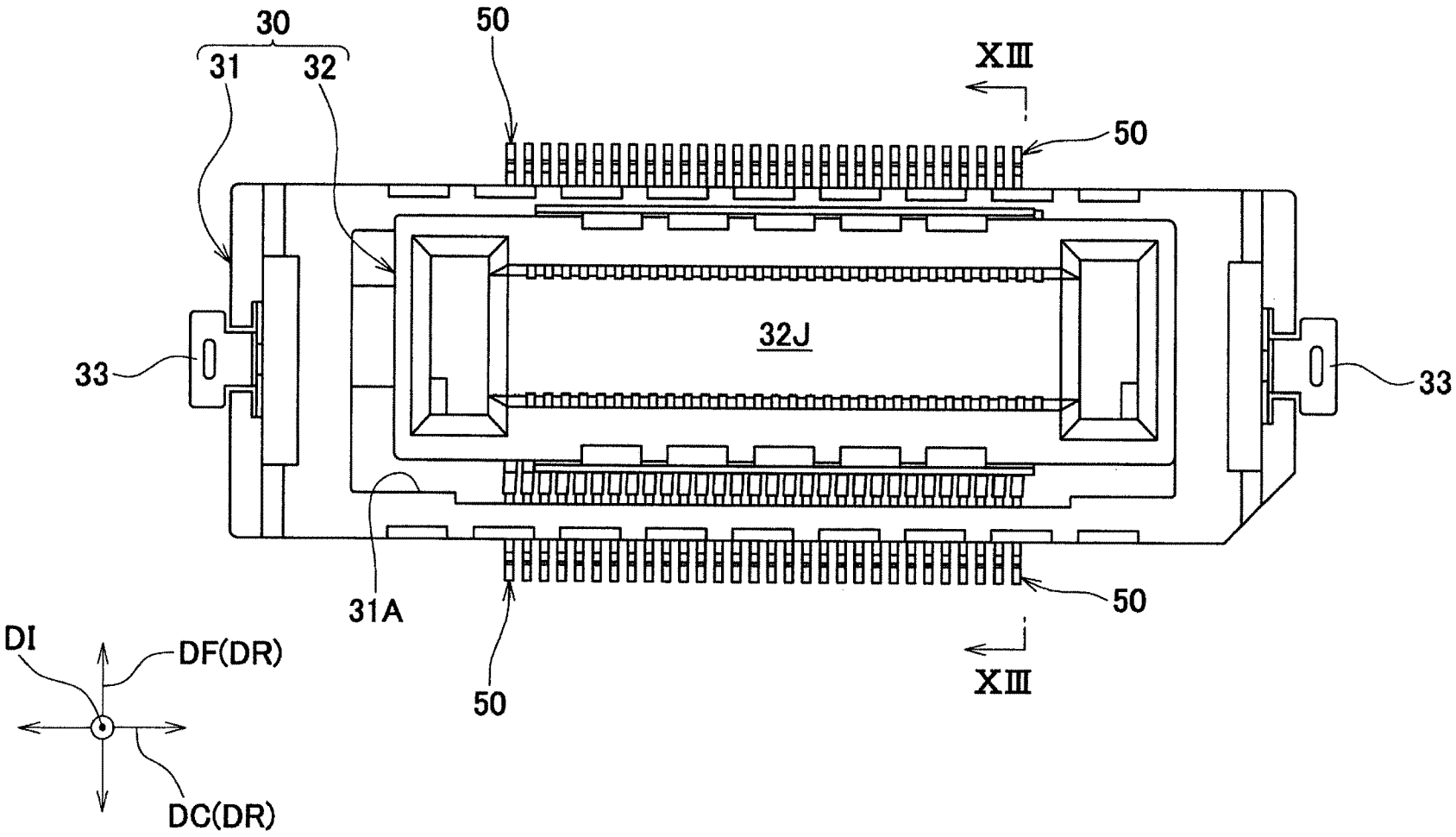
FIG. 11 is a plan view of the connector, in a state in which a second housing appearing in FIG. 1 is moved.
Figure 12:
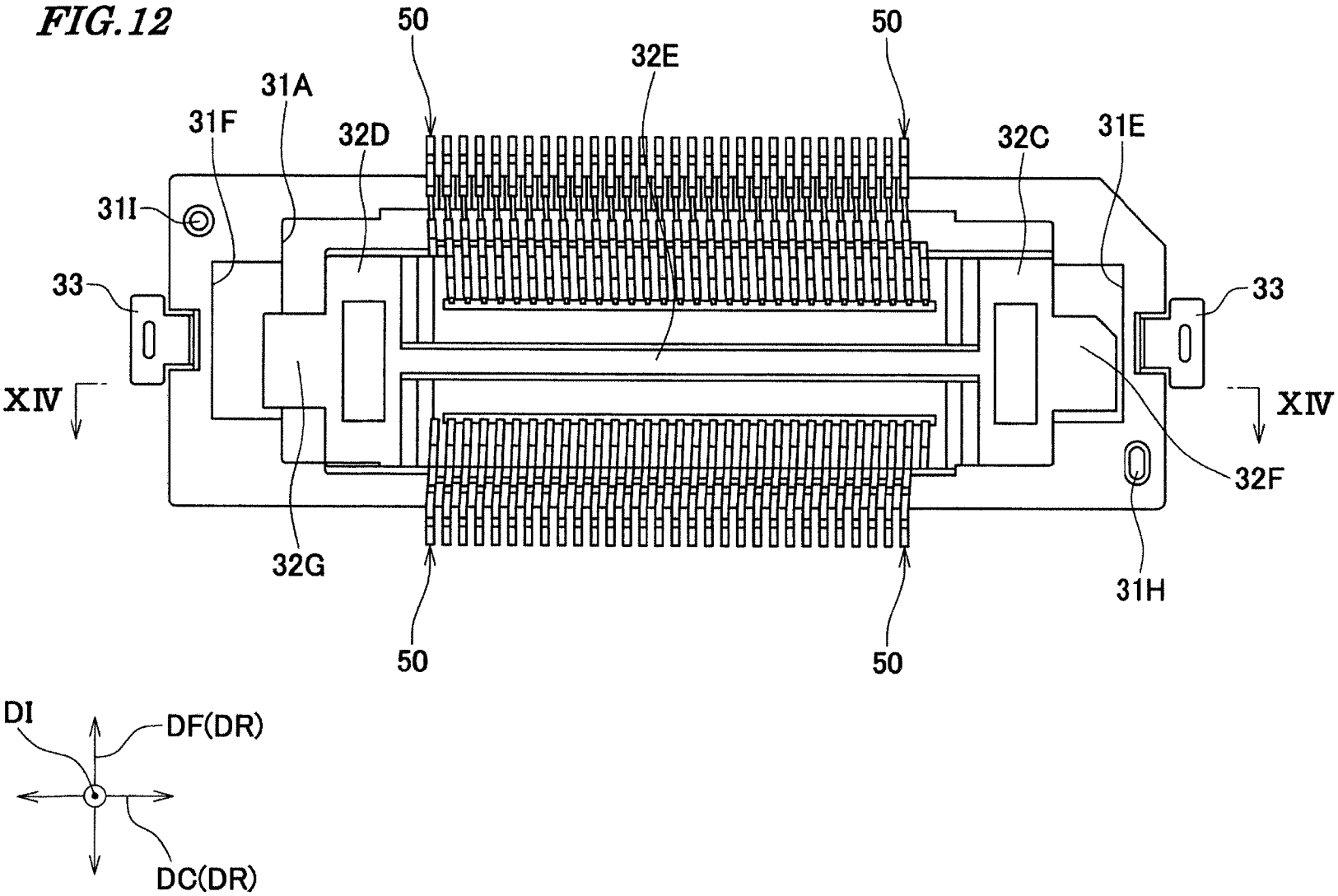
FIG. 12 is a bottom view of the connector shown in FIG. 11.
Figure 13:
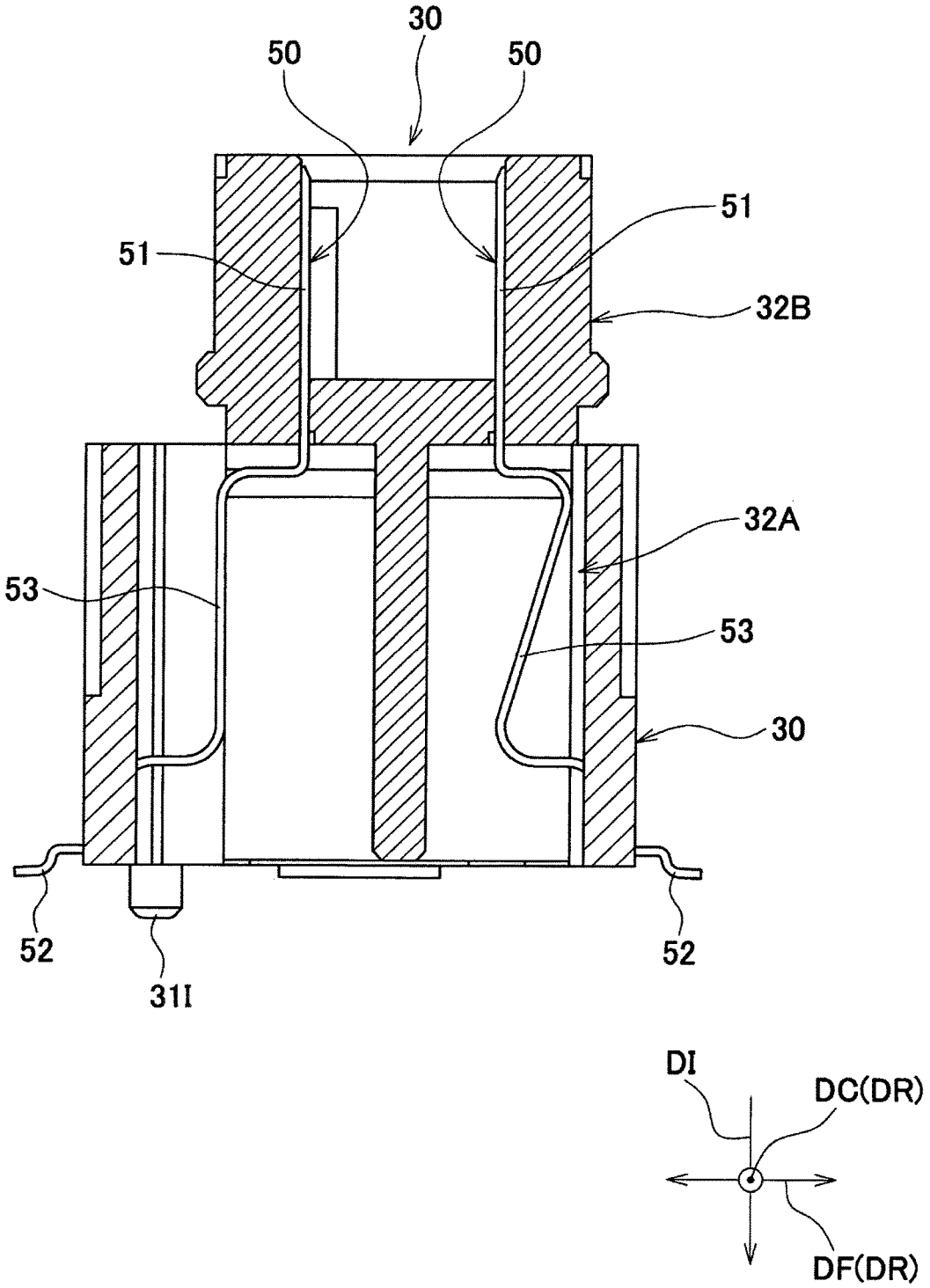
FIG. 13 is a cross-sectional view taken along XIII-XIII in FIG. 11.

As shown in FIGS. 8 to 10, each contact 50 includes a contact portion 51, a connection portion 52, and a linking portion 53. The contact portion 51 includes a contact portion body 51A and a press-fitting portion 51B. The contact portion body 51A is disposed in an associated one of the grooves 32K of the fitting part 32B, and is brought into contact with an associated one of mating contacts of the mating connector inserted in the receiving space 32J of the second housing 32. The press-fitting portion 51B is continuous with the contact portion body 51A. The press-fitting portion 51B includes a protrusion 51C. The press-fitting portion 51B is press-fitted in an associated one of the press-fitting holes 32L of the fitting part 32B of the second housing 32, whereby the contact 50 is held by the second housing 32 (see FIG. 5).

The connection portion 52 includes a connection portion body 52A and a press-fitting portion 52B. The connection portion body 52A is substantially crank-shaped, part of the connection portion body 52A is disposed in an associated one of the grooves 31D of the first housing 31, and the other part of the connection portion body 52A protrudes from the first housing 31 to the outside, and is connected to the printed circuit board. The press-fitting portion 52B is continuous with the connection portion body 52A. Part of the press-fitting portion 52B is press-fitted in an associated one of the press-fitting grooves 31C of the first housing 31, whereby the contact 50 is held by the first housing 31 (see FIG. 5).

The linking portion 53 having a substantially S-shape is elastically deformable, and connects the contact portion 51 and the connection portion 52. The linking portion 53 includes a linear portion 53A, a first bent portion 53B, and a second bent portion 53C. The linear portion 53A is slightly inclined with respect to the receiving direction DI (see FIGS. 5 and 9). The first bent portion 53B extends from one end of the linear portion 53A in an arcuate manner, and is continuous with the press-fitting portion 51B of the contact portion 51. The second bent portion 53C extends from the other end of the linear portion 53A in an arcuate manner in a direction opposite to the direction in which the first bent portion 53B extends, and is continuous with the press-fitting portion 52B of the connection portion 52. The shape of the linking portion 53 is not limited to the substantially S-shape, but may be formed into various shapes, such as a substantially Z-shape.

In a state in which each contact 50 is not in an elastically deformed state before fitting the connector 1 and the mating connector (see FIG. 9), when the dimension of the linking portion 53 in the receiving direction DI is represented by A, and the dimension of the linking portion 53 in the front-rear direction (orthogonal direction) DF orthogonal to both the receiving direction DI and the contact arranging direction DC is represented by B, the dimension A is larger than the dimension B. It is preferable that the dimension A is approximately two or more times as large as the dimension B, and in the present embodiment, the dimension A is set to approximately seven times as large as the dimension B.

The linear portion 53A of the linking portion 53 has a middle portion having a width D smaller than that of the other part of the linking portion 53A.

The linear portion 53A of the linking portion 53 has opposite end portions having a width C larger than a width E of the contact portion body 51A of the contact portion 51.

Figure 5:
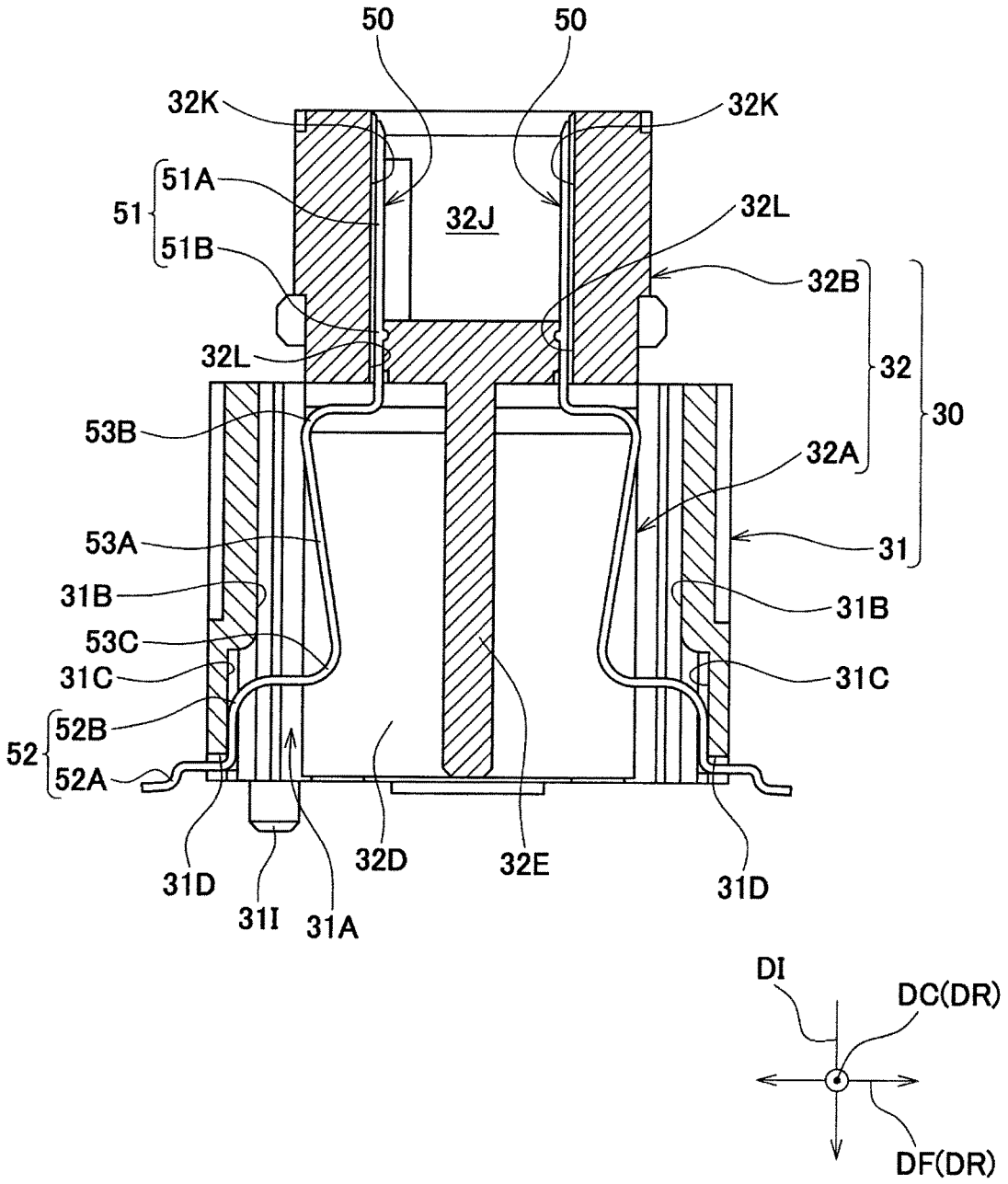
FIG. 5 is a cross-sectional view taken along V-V in FIG. 3, in which hatching of contacts is omitted.
Figure 6:
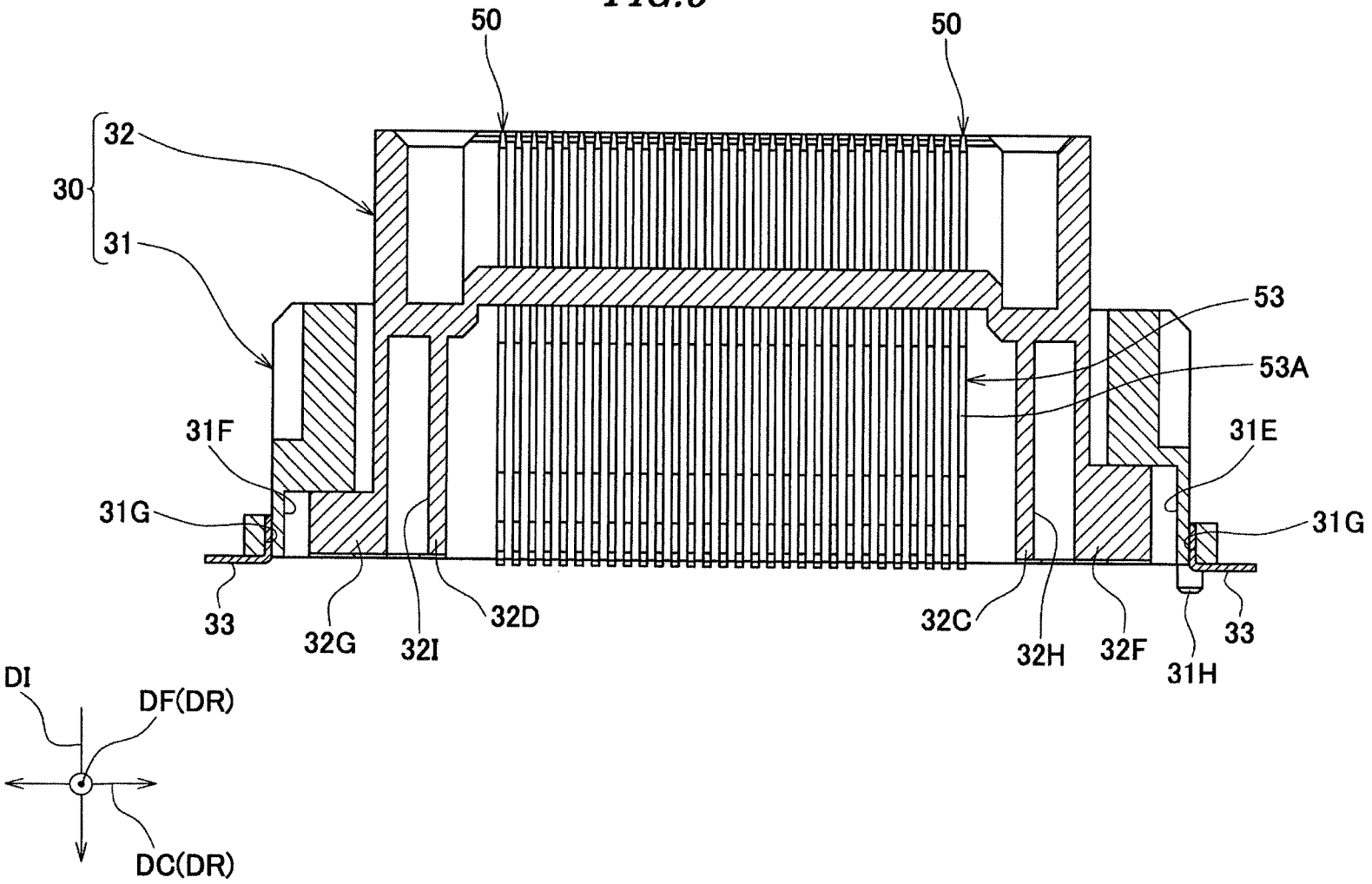
FIG. 6 is a cross-sectional view taken along VI-VI in FIG. 4.
Figure 7:
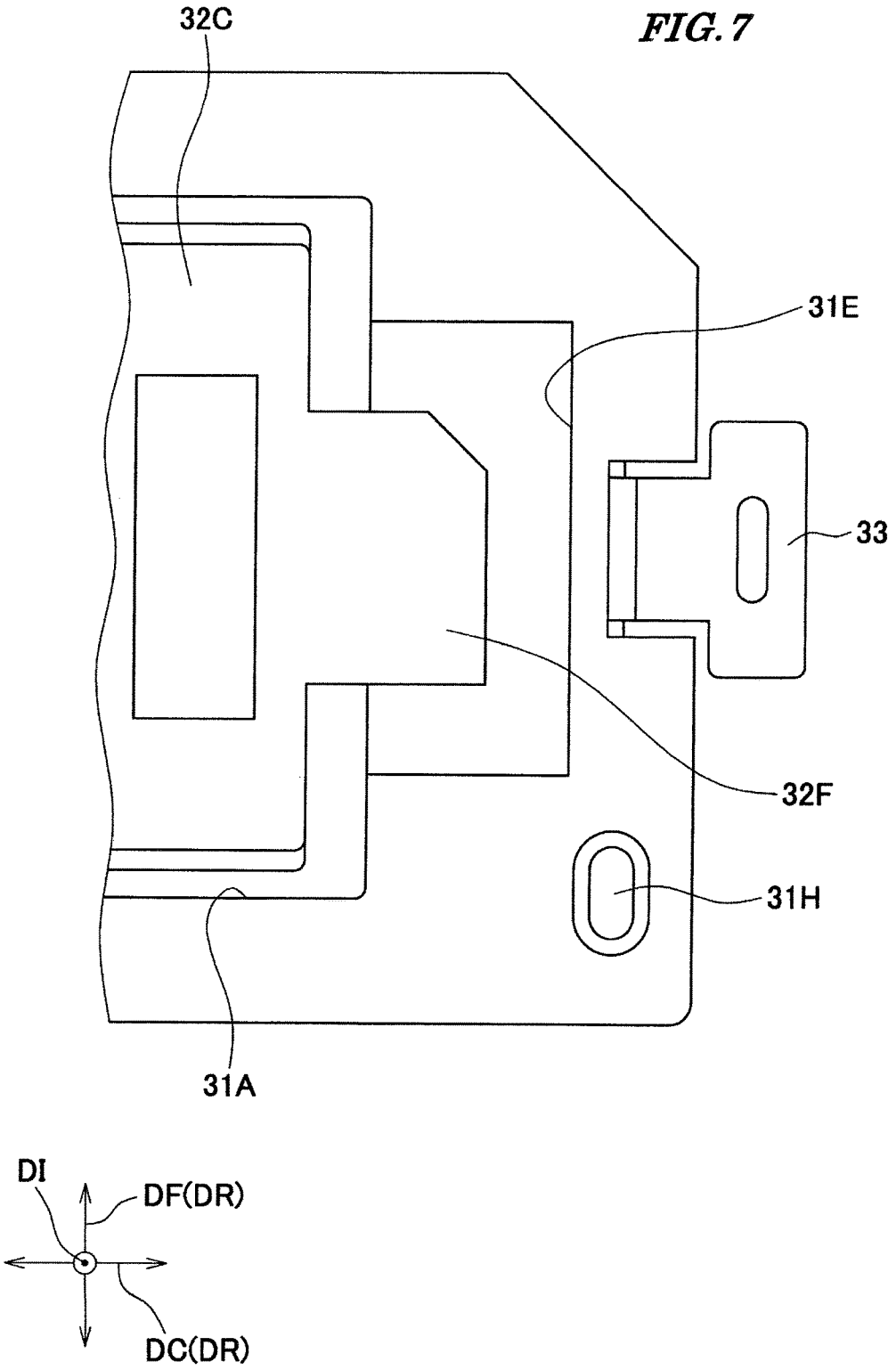
FIG. 7 is a partial enlarged view of the connector shown in FIG. 4.

Next, a description will be given of how to assemble the connector 1 according to the present embodiment with reference to FIGS. 5 and 6.

First, the holddowns 33 in a state connected to a carrier (not shown) are press-fitted in the press-fitting holes 31G of the first housing 31, respectively.

Next, the carrier is separated from the holddowns 33.

Then, the second housing 32 is inserted in the receiving space 31A of the first housing 31. At this time, the protruding portion 32F and the protruding portion 32G of the second housing 32 are inserted in the accommodating recess 31E and the accommodating recess 31F of the first housing 31, respectively.

Next, the press-fitting portions 51B and 52B of the plurality of contacts 50 are press-fitted in the press-fitting holes 32L of the second housing 32 and the press-fitting grooves 31C of the first housing 31, respectively. At this time, the plurality of contacts 50 are in a state connected to a carrier (not shown).

Finally, the carrier is separated from the plurality of contacts 50.

By performing the above processes, assembly of the connector 1 is completed.

When the connector 1 and the mating connector are fitted to each other, if positions of the connector 1 and the mating connector deviate from each other in both the contact arranging direction DC and the front-rear direction DF, as shown in FIGS. 11 to 15, the second housing 32 of the connector 1 relatively moves with respect to the first housing 31 in both the contact arranging direction DC and the front-rear direction DF, whereby the misalignment between the connector 1 and the mating connector is compensated for.

The movement of one row of contacts 50 (right row of contacts 50 as viewed in FIG. 13) in this case will be described.

Before fitting the connector 1 and the mating connector, as shown in FIG. 9, the first bent portion 53B and the second bent portion 53C of the linking portion 53 of each contact 50 are opposed to each other in the receiving direction DI. Further, as shown in FIG. 6, the plurality of contacts 50 are arranged at equally-spaced intervals in the contact arranging direction DC, and when the contacts 50 are viewed from the front-rear direction DF, the linear portion 53A of the liking portion 53 of each contact 50 is parallel to the receiving direction DI.

Figure 14:
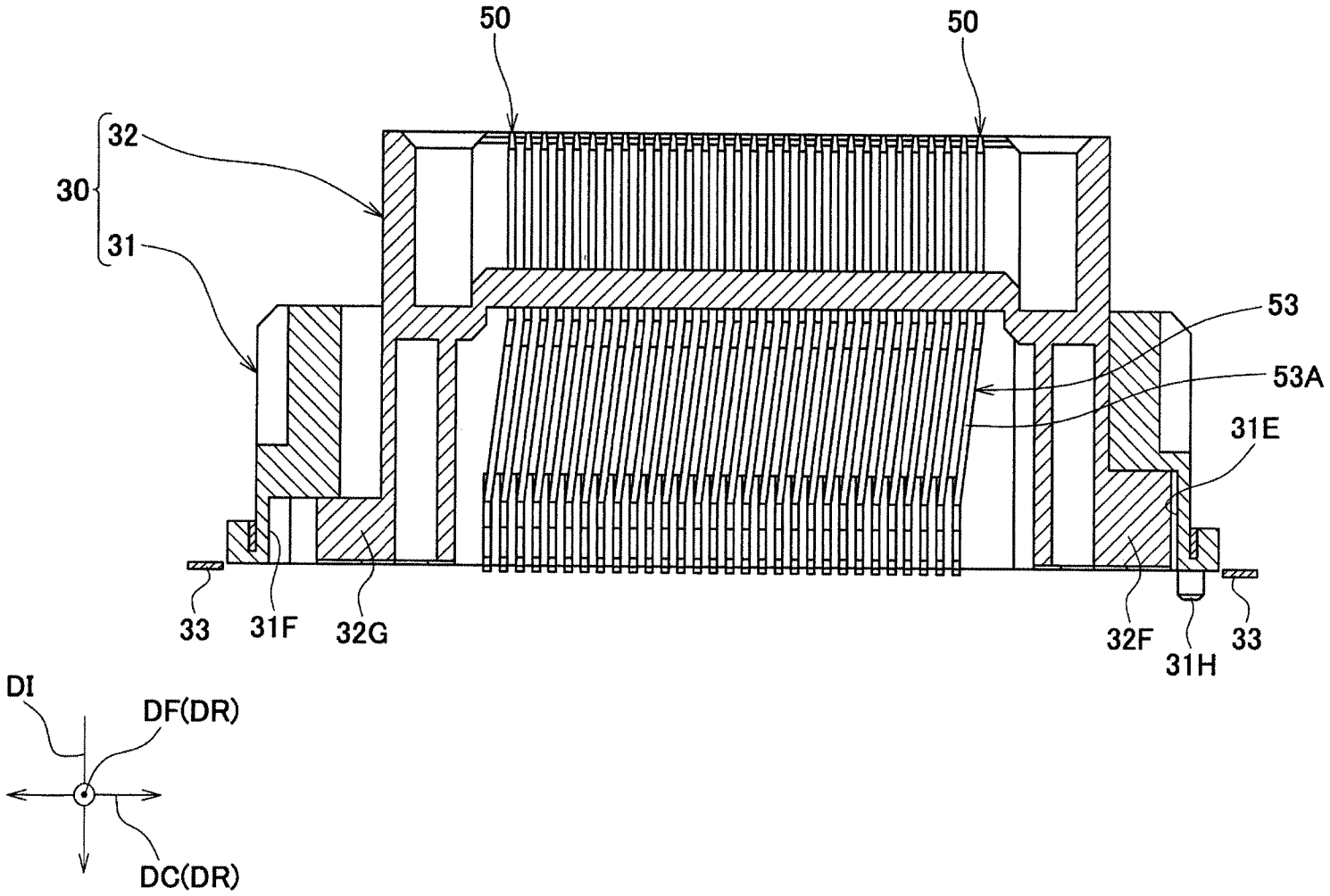
FIG. 14 is a cross-sectional view taken along XIV-XIV in FIG. 12.
Figure 15:
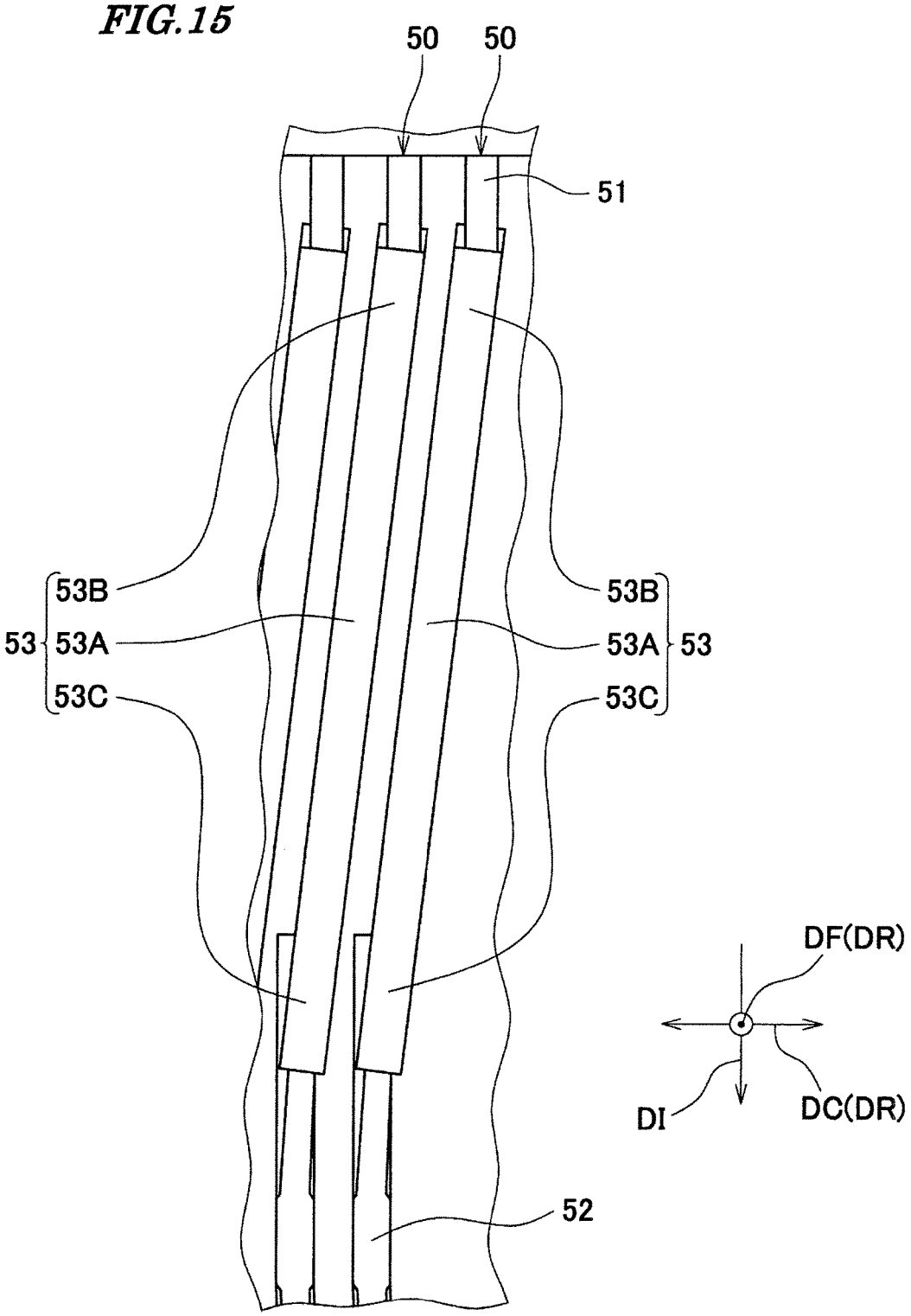
FIG. 15 is a partial enlarged view of the connector shown in FIG. 14.

When the connector 1 and the mating connector are fitted to each other, assuming that the second housing 32 moves by one pitch of the contacts 50 in the contact arranging direction DC, as shown in FIGS. 14 and 15, the linear portions 53A of the linking portions 53 of the contacts 50 are inclined with respect to the receiving direction DI, and the first bent portion 53B of one contact 50 and the second bent portion 53C of another contact 50 which is adjacent to the one contact 50 in the contact arranging direction DC are opposed to each other in the receiving direction DI.

However, in the present embodiment, as shown in FIG. 9, the dimension B is set to approximately one-seventh of the dimension A, i.e. the difference between the dimensions A and B is set to be as large as possible. The first bent portion 53B and the second bent portion 53C which are opposed to each other in the receiving direction DI are both short in length in the front-rear direction DF, and what is more, the distance in the receiving direction DI between the first bent portion 53B of one contact 50 and the second bent portion 53C of the other contact 50 which is adjacent to the one contact 50 is large, and hence the one contact 50 is difficult to be electrically influenced by the other contact 50.

Note that in the other row of contacts 50 (left row of contacts 50 as viewed in FIG. 13), when the second housing 32 is moved, the first bent portion 53B of one contact 50 and the second bent portion 53C of the other contact 50 which is adjacent in the contact arranging direction DC are not opposed to each other in the receiving direction DI, and what is more, the distance therebetween in the receiving direction DI is large, and hence the one contact 50 is difficult to be electrically influenced by the other contact 50 which is adjacent to the one contact 50.

According to the present embodiment, when the second housing 32 is moved in the contact arranging direction DC or the front-rear direction DF, the contacts 50 are difficult to be electrically influenced by the other contacts 50 adjacent in the contact arranging direction DC, and hence it is possible to realize excellent transmission of high-speed signals.

Figure 18:
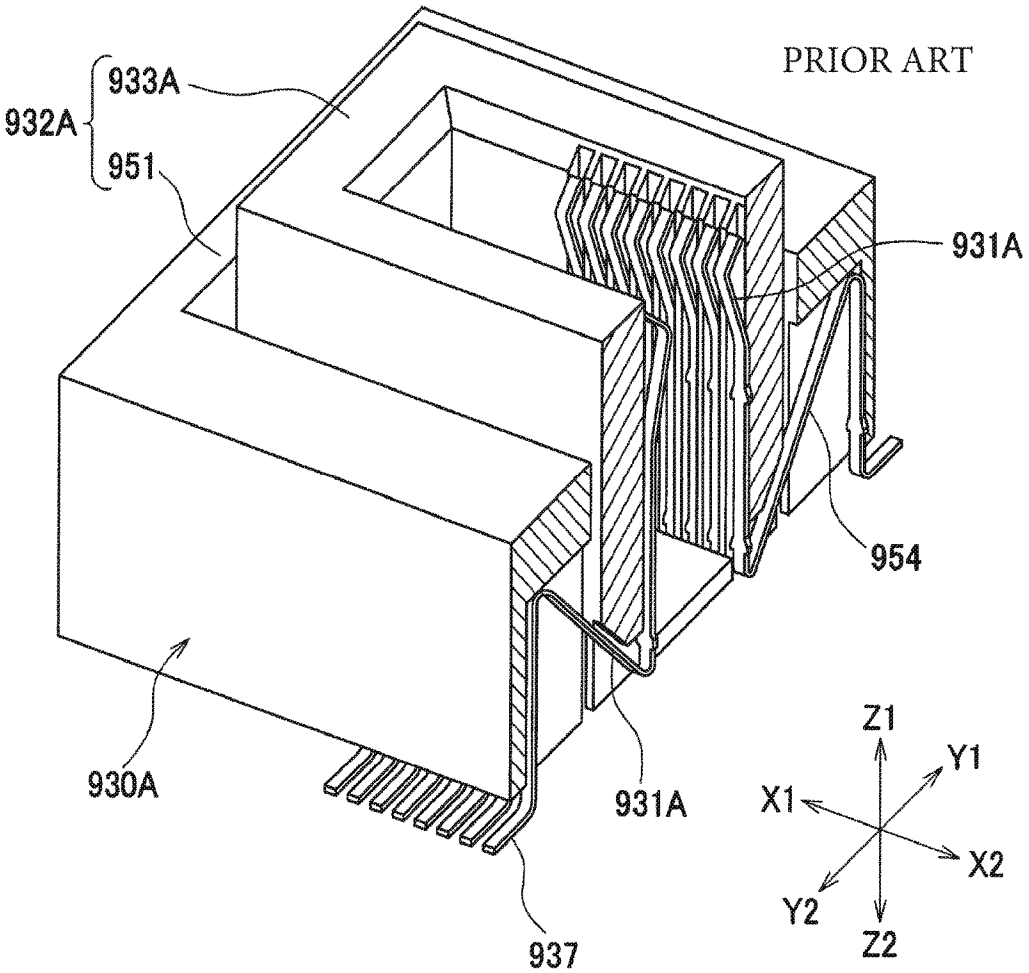
FIG. 18 is a perspective view of a conventional connector, partly in cross-section.
Figure 19:
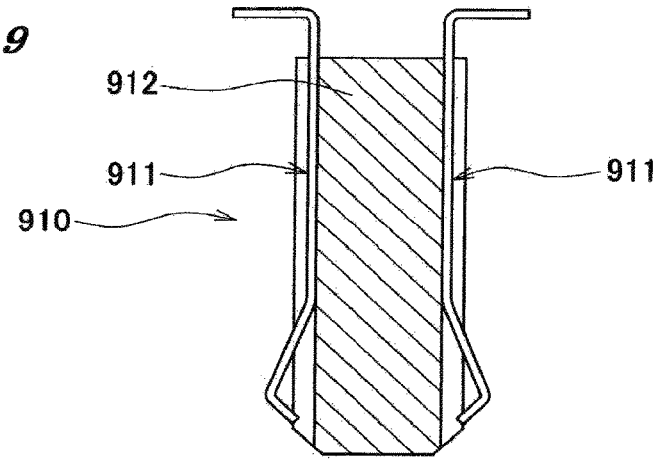
FIG. 19 is a cross-sectional view of another connector and the connector shown in FIG. 18 in a state before the former is fitted in the latter.
Figure 19:
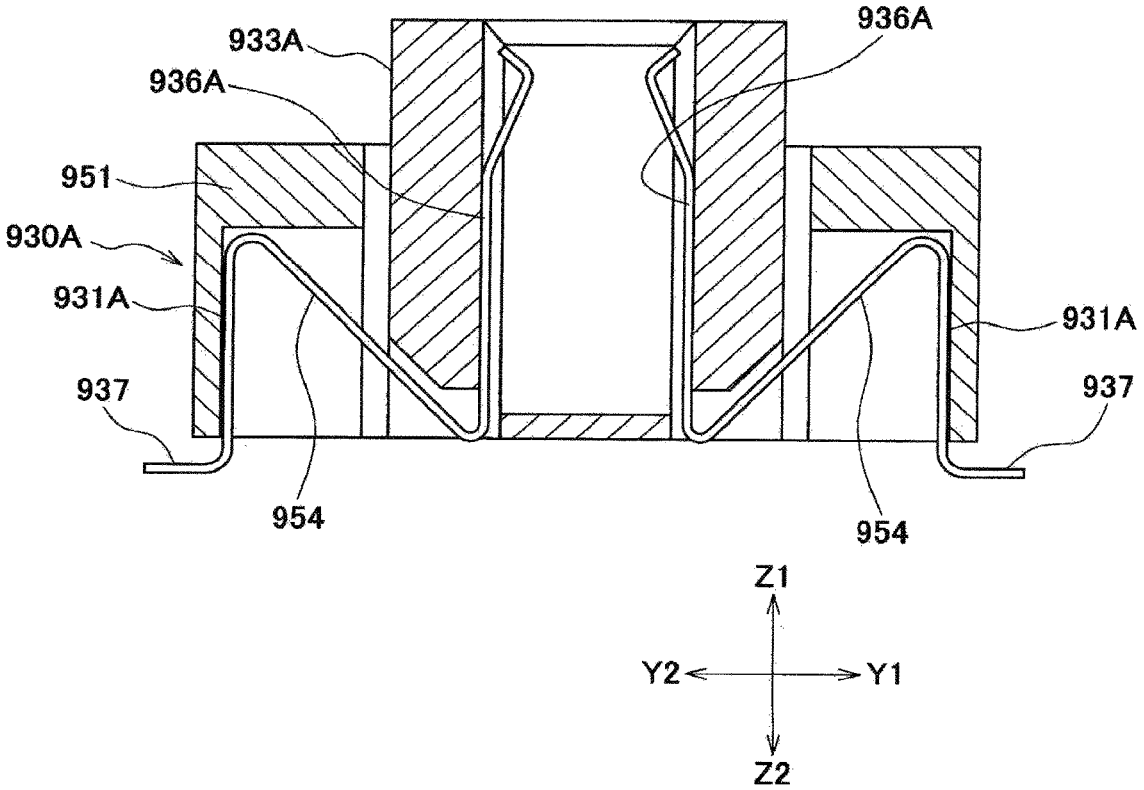

Further, since in the present embodiment, the dimension B is set to approximately one-seventh of the dimension A, it is possible to make the transmission path length shorter than that of the conventional connector (see FIGS. 18 and 19). As a consequence, the electrical characteristics of the connector are improved, whereby it is possible to realize excellent transmission of high-speed signals.

Further, since the width D of the middle portion of the linear portion 53A of the linking portion 53 is made smaller than that of the other part of the linear portion 53A, when the linking portion 53 is elastically deformed, it is possible to reduce stress generated on the first bent portion 53B and the second bent portion 53C, and reduce the operation force.

Further, the width C of the opposite ends of the linear portion 53A of the linking portion 53 is made larger than the width E of the contact portion body 51A of the contact portion 51 to thereby make it possible to adjust electrical characteristics, and hence the connector according to the present embodiment is suitable as a connector for high-speed transmission.

Although in the above-described embodiment, the connector 1 is configured such that the second housing 32 can relatively move with respect to the first housing 31 in both the contact arranging direction DC and the front-rear direction DF, it is only required that the second housing 32 can relatively move with respect to the first housing 31 at least in the contact arranging direction DC.

Figure 16:
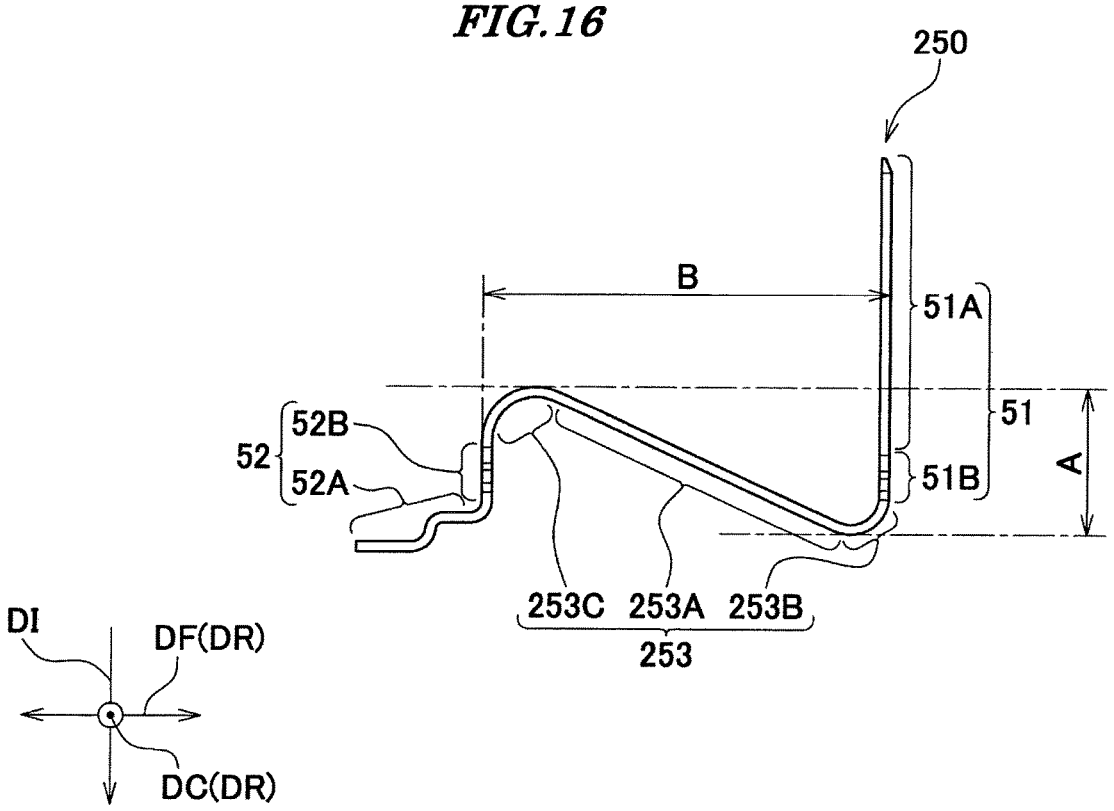
FIG. 16 is a side view of a contact of a connector according to a second embodiment of the present invention.
Figure 17:
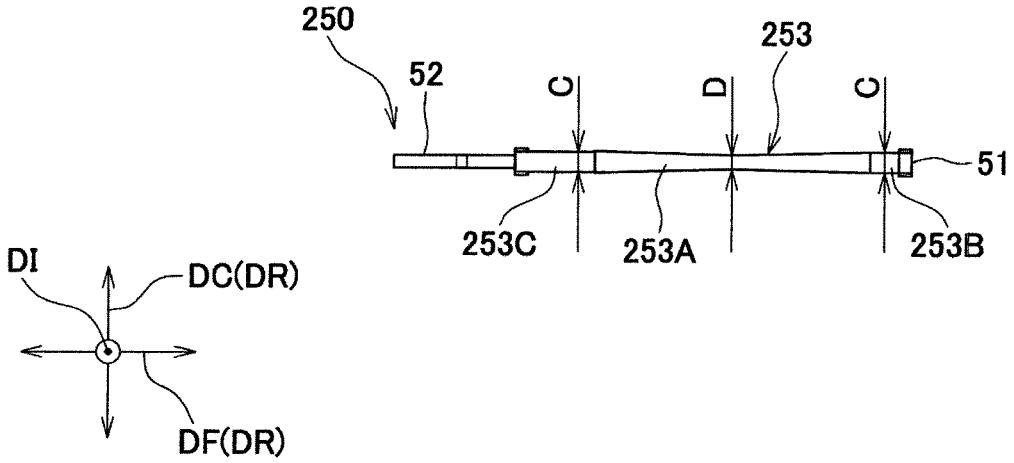
FIG. 17 is a plan view of the contact shown in FIG. 16.

Next, a description will be given of a connector according to a second embodiment of the present invention with reference to FIGS. 16 and 17. This connector is comprised of a housing (not shown) having the same construction as the housing 30, and a plurality of contacts 250 which are held by the housing. The same components as those of the first embodiment are denoted by the same reference numerals, and description thereof is omitted.

A linking portion 253 of each contact 250 has a shape giving an image of a character N of the alphabet.

The linking portion 253 includes a linear portion 253A, a first bent portion 253B, and a second bent portion 253C. The first bent portion 253B extends from one end of the linear portion 253A in an arcuate manner, and is continuous with the press-fitting portion 51B of the contact portion 51. The second bent portion 253C extends from the other end of the linear portion 253A in an arcuate manner in a direction opposite to the direction in which the first bent portion 253B extends, and is continuous with the press-fitting portion 52B of the connection portion 52.

In a state in which the contact 250 is not elastically deformed (see FIG. 16), the dimension A of the linking portion 253 in the receiving direction DI is smaller than the dimension B of the linking portion 253 in the front-rear direction DF. In the present embodiment, the dimension A is set to approximately half the dimension B.

According to the second embodiment, it is possible to obtain the same advantageous effects as provided by the first embodiment.

Although in the first embodiment, the dimension A is set to approximately seven times as large as the dimension B, and in the second embodiment, the dimension A is set to half the dimension B, the ratio between the dimensions A and B is not limited to these. In a connector constructed such that each contact 50 has portions opposed to each other in the receiving direction DI as in the first embodiment, it is only required that the dimension A is made larger than the dimension B, and in a connector constructed such that each contact 50 has portions opposed to each other in the front-rear direction DF as in the second embodiment, it is only required that the dimension A is made smaller than the dimension B.

Note that in a case where it is not necessary to reduce the operation force, the width D of the respective middle portions of the linear portions 53A and 253A of the linking portions 53 and 253 is not required to be reduced, but it may be equal to the width C of the respective opposite ends of the linear portions 53A and 253A. That is, the linear portion 53A and 253A may have a uniform width.

Further, although in the above-described embodiments, the contacts 50 and 250 are arranged in the contact arranging direction DC in two rows, the contacts 50 and 250 may be arranged in the contact arranging direction DC in one row.

Although the description has been given of the case where the connector 1 of the above-described embodiments is used as a high-speed transmission connector, the connector 1 may be used as a non-high-speed transmission connector.

It is further understood by those skilled in the art that the foregoing are the preferred embodiments of the present invention, and that various changes and modification may be made thereto without departing from the spirit and scope thereof.

What is claimed is:

1. A connector including:

a housing; and a plurality of contacts that are held by the housing, wherein the housing includes:

a first housing that is configured to be disposed on an object to be connected, and a second housing that is capable of receiving a mating connector therein and is fitted in the first housing in a manner movable in a moving direction that is orthogonal to a receiving direction of receiving the mating connector, wherein each contact includes:

a contact portion that is held by the second housing and is configured to be brought into contact with an associated one of mating contacts of the mating connector, a connection portion that is held by the first housing and is configured to be connected to the object to be connected, and a linking portion that is elastically deformable and connects the contact portion and the connection portion, wherein the contact portion includes a contact-portion-side press-fit portion that is press-fitted into the second housing, wherein the connection portion includes a connection-portion-side press-fit portion that is press-fitted into the first housing, wherein when a dimension of the linking portion in the receiving direction is represented by A, and a dimension of the linking portion in an orthogonal direction orthogonal to both the receiving direction and a contact arranging direction of arranging the contacts is represented by B, A>B holds, wherein the linking portion has an S-shape and includes a linear portion, a first bent portion which extends from one end of the linear portion and which is continuous with the contact portion, and a second bent portion which extends from the other end of the linear portion and which is continuous with the connection portion, wherein substantially the entire first bent portion and substantially the entire second bent portion oppose each other in the receiving direction, wherein A is at least two times as large as B, and wherein when viewed from the orthogonal direction, a middle portion of the linear portion is smaller in width than opposite end portions of the linear portion.

2. The connector according to claim 1, wherein when viewed from the orthogonal direction, the opposite end portions of the linear portion are larger in width than the contact portion.

3. The connector according to claim 1, wherein the moving direction is at least the contact arranging direction.

4. The connector according to claim 1, wherein the contacts are arranged in the contact arranging direction in two rows.

5. A connector including:

a housing; and a plurality of contacts that are held by the housing, wherein the housing includes:

a first housing that is configured to be disposed on an object to be connected, and a second housing that is capable of receiving a mating connector therein and is fitted in the first housing in a manner movable in a moving direction orthogonal to a receiving direction of receiving the mating connector, wherein each contact includes:

a contact portion that is held by the second housing and is configured to be brought into contact with an associated one of mating contacts of the mating connector, a connection portion that is held by the first housing and is configured to be connected to the object to be connected, and a linking portion that is elastically deformable at an end thereof connected to the contact portion and at an end thereof connected to the connection portion, wherein when a dimension of the linking portion in the receiving direction is represented by A, and a dimension of the linking portion in an orthogonal direction orthogonal to both the receiving direction and a contact arranging direction of arranging the contacts is represented by B, A<B holds, wherein the linking portion has an N-shape, and includes a linear portion, a first bent portion which extends from one end of the linear portion and is continuous with the contact portion, and a second bent portion which extends from the other end of the linear portion and is continuous with the connection portion, wherein the first bent portion and one end portion of the contact portion continuous therewith, and the second bent portion and one end portion of the connection portion continuous therewith, oppose each other in the orthogonal direction, wherein B is at least two times as large as A, and wherein when viewed from the receiving direction, a middle portion of the linear portion is smaller in width than opposite end portions of the linear portion.

6. The connector according to claim 5, wherein when viewed from the receiving direction, the opposite end portions of the linear portion are larger in width than the contact portion.

7. The connector according to claim 5, wherein the moving direction is at least the contact arranging direction.

8. The connector according to claim 5, wherein the contacts are arranged in the contact arranging direction in two rows.

* * * * *